United States Patent [19]

Iio et al.

[11] Patent Number: 4,799,037

[45] Date of Patent: Jan. 17, 1989

[54] CIRCUIT INTERRUPTER

[75] Inventors: Tsukasa Iio; Yoshinori Mochizuki; Hiroshi Fujii; Yasusi Genba; Hideaki Moriwaki, all of Fukuyama, Japan

[73] Assignee: Mitsubishi Denki Kabushiki Kaisha, Japan

[21] Appl. No.: 92,944

[22] Filed: Sep. 4, 1987

[30] Foreign Application Priority Data

Sep. 9, 1986 [JP] Japan ..... 61-138777[U]

[51] Int. Cl.[4] ..... H01H 75/00

[52] U.S. Cl. ..... 335/46; 335/193; 335/277; 200/144 R

[58] Field of Search ..... 335/46, 193, 277; 202/146 R, 144 R

[56] References Cited

U.S. PATENT DOCUMENTS 4,626,811 12/1986 McKee et al. ..... 335/193

FOREIGN PATENT DOCUMENTS 51-13860 5/1976 Japan .

*Primary Examiner*—Robert S. Macon

*Attorney, Agent, or Firm*—Leydig, Voit & Mayer

[57] ABSTRACT

A circuit interrupter comprises, in a housing, a movable contact assembly having a movable contact carrier and a contact arm supporting the movable contact carrier, and a cross bar secured to the movable contact assembly for allowing the movable contact assembly to rotate thereabout. The circuit interrupter also comprises a bearing assembly secured to the housing for rotatably supporting the cross bar, and the bearing assembly has a stop surface capable of being engaged by the movable contact assembly for determining the OFF position of the movable contact assembly.

1 Claim, 5 Drawing Sheets

CIRCUIT INTERRUPTER

BACKGROUND OF THE INVENTION

This invention relates to a circuit interrupter and, more particularly, to a circuit interrupt in which a movable contact arm stopper is provided for determining the OFF position of the movable contact arm.

FIGS. 1 and 2 illustrate one example of a conventional circuit interrupter of the type to which the present invention pertains. FIG. 1 is a sectional side view of the conventional circuit interrupter in the ON position, and FIG. 2 is a partly cut-away side view of the circuit interrupter shown in FIG. 1 in the OFF position.

In these figures, the circuit interrupter comprises an electrically insulating housing 1 composed of a cover 1*a* and a base 1*b* on which stationary contact 2 having secured thereon a stationary contact element 2*a* is fixedly mounted. A frame 3 is also firmly mounted to the base 1*b* by screws 4 (only one is shown). The frame 3 supports at its projection 3*a* an operating handle 5 so that the operating handle 5 is rotatable about the projection 3*a*. The operating handle 5 has mounted thereon a cradle 6 pivotable relative to the operating handle 5.

A toggle link 8, which includes an upper toggle link 8*a* and a lower toggle link 8*b* pivotally connected to the upper toggel link 8*a* by a knee pin 9, is connected to the operating handle 5 by an upper toggle link pin 7 at the upper end of the upper toggle link 8*a*. The lower end of the lower toggle link 8*b* is connected by a pin 12 to a movable contact arm 11 which is rotatably mounted on a cross bar 13 on which the movable contact arm 11 is pivotably supported. The cross bar 13 is rotatably supported on the base 1*b* by a bearing assembly 14 secured by screws 15 on the base 1*b*. The knee pin 9 of the toggle link 8 is biased toward the operating handle 5 by a tension spring 10 connected between the pin 9 and the handle 5, thus maintaining the upper toggle link 8*a* in engagement with the projection 7. A movable contact carrier 16 having a movable contact element 16*a* secured thereon is mounted to the movable contact arm 11. The movable contact carrier 16 is electrically connected to a terminal conductor 17 through a flexible conductor 18.

The circuit interrupter also comprises an electromagnetic trip device including an electromagnetic device 19 which has a movable plunger 19*a*. A thermally response trip device having a bimetal 20 with an adjusting screw 20*a* is also provided. In order to pick up the movements of two kinds of trip devices, a trip bar 21 which is rotated by the screw 20*a* or the plunger 19*a* is provided. The trip bar 21 is in engagement with a latch 22 which is in engagement with a latch 23 which releasably latches the cradle 6.

The conventional circuit interrupter further comprises a toggle link stopper 25 pivotally mounted on the frame 3 by a pivot pin. The toggle link stopper 25 is limited in its movement by a stopper pin 24 mounted on the frame 3.

When the circuit interrupter is in the ON position shown in FIG. 1, the current flows from the stationary contact 2 to the terminal conductor 17 through a stationary contact element 2*a*, the movable contact element 16*a*, the movable contact carrier 16 and the flexible conductor 18. When the operating handle 5 is moved in the direction of an arrow 26, the upper end of the tension spring 10 is moved beyond dead center of the line of action of the spring 10, causing the tension spring 10 to collapse the toggle link 8 to move the movable contact carrier 16 upwards together with the movable contact arm 11 until the operating mechanism takes the position shown in FIG. 2 in which the movable contact carrier 16 is in engagement with the stopper pin 24.

When a very large current flows through the circuit interrupter in the ON position shown in FIG. 1, the electromagnetic trip device is actuated to push out the plunger 19*a* from the electromagnetic device 19. Alternatively, when an overcurrent flows through the circuit interrupter in the ON position shown in FIG. 1, the thermally responsive trip device is actuated to push the trip bar 21 by the adjusting screw 20*a*. In either case, the trip bar 21 is rotated to rotate the latch member 22 and then the latch 23 rotates to release the cradle 6 under the action of the spring 10 which biases the cradle 6 to rotate clockwise. The cradle 6 is then rotated clockwise in FIG. 1 so that the toggle link pin 7 moves overcenter causing the toggle link 8 to collapse to rotate the movable contact carrier 16 together with the movable contact arm 11 about the cross bar 13 until they are brought into the TRIP position in which the movable contact element 16*a* is separated from the stationary contact element 2*a*.

With the conventional circuit interrupter as above described, when the circuit interrupter is moved into the OFF position, the movable contact carrier 16 collides with the stopper pin 24 mounted on the frame 3. Upon collision, the frame 3 as well as the stopper pin 24 are subjected to a shock and vibration. This vibration of the frame 3 is transmitted to the trip bar 21, the latch member 22 and the latch 23, which often causes disengagement or erroneous unlatching of these elements, resulting in an erroneous tripping of the circuit interrupter. Also, the movable contact carrier 16 can be deformed by any large shock transmitted by the stopper pin 24.

SUMMARY OF THE INVENTION

Accordingly, an object of the present invention is to provide a circuit interrupter in which the problem of the vibration of the frame is significantly decreased.

Another object of the present invention is to provide a circuit interrupter in which the contact arm carrier stopper has a simple structure.

Another object of the present invention is to provide a circuit interrupter in which the erroneous tripping of the circuit interrupter due to the vibration of the frame and trip mechanism can be eliminated.

A further object of the present invention is to provide a circuit interrupter in which the deformation of the movable contact carrier due to mechanical shocks can be eliminated.

With the above objects in view, the circuit interrupter of the present invention comprises a movable contact carrier, a contact arm supporting said movable contact carrier, a cross bar secured to said contact arm for allowing said contact arm to rotate thereabout, and a bearing for rotatably supporting said cross bar, said bearing having a stop surface capable of being engaged by said movable contact carrier for determining the OFF position of said movable contact carrier.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
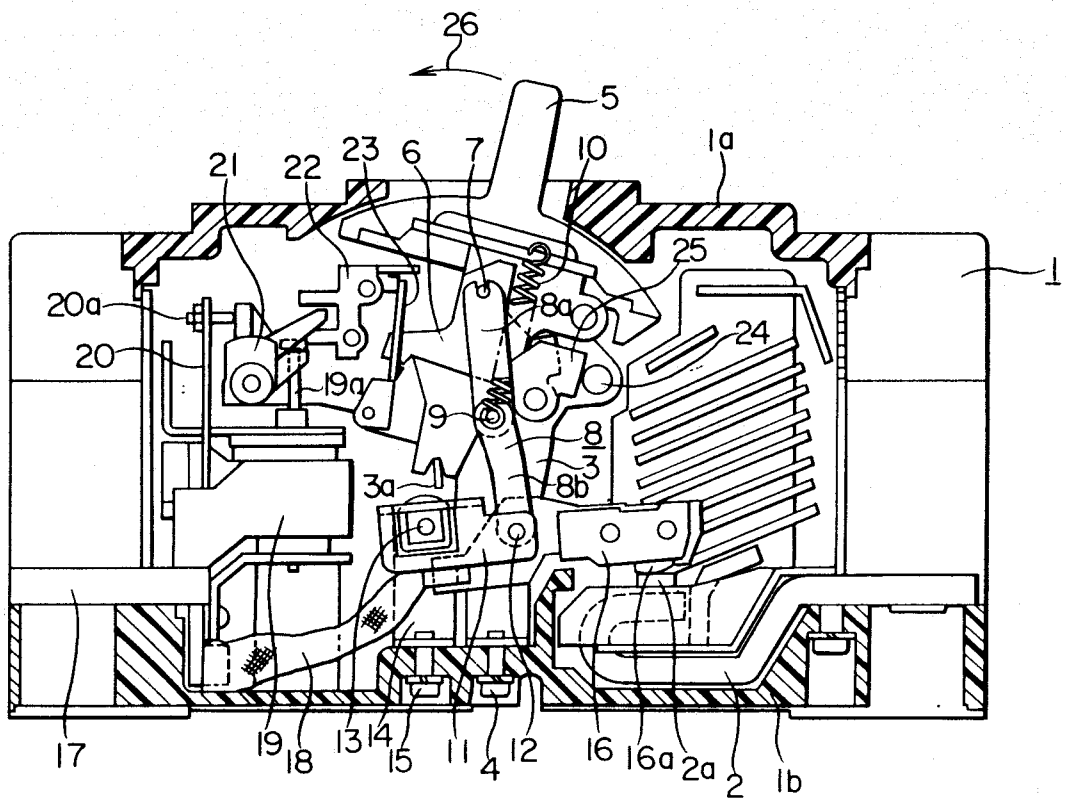
FIG. 1 PRIOR ART
FIG. 1 is a sectional side view of a conventional circuit interrupter in the ON position.
Figure 2:
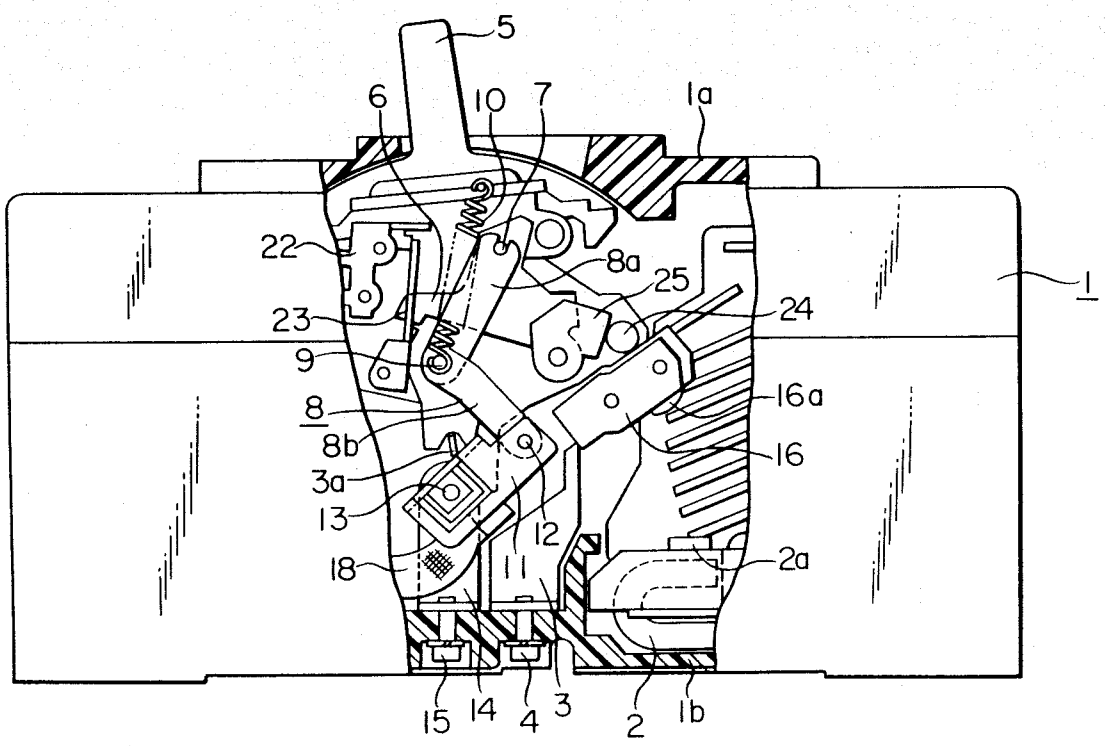
FIG. 2 PRIOR ART
FIG. 2 is a partly cut-away side view of the circuit interrupter shown in FIG. 1 but in the OFF position.
Figure 3:
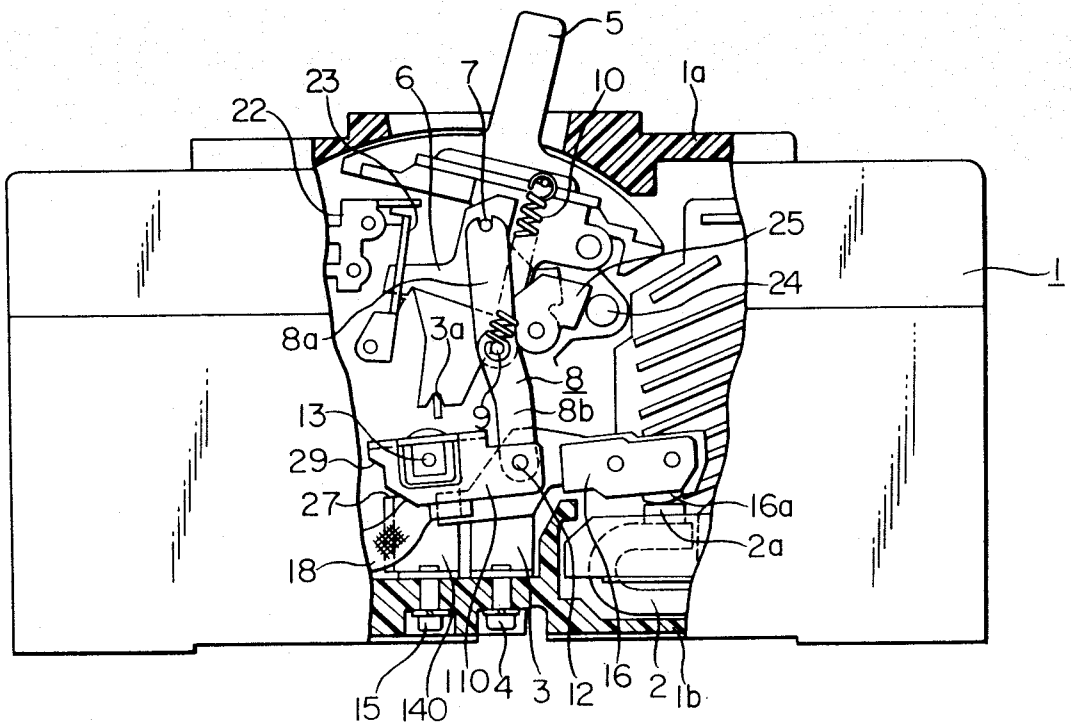
FIG. 3 is a partly cut-away side view of the circuit interrupter of the present invention in the ON position.
Figure 4:
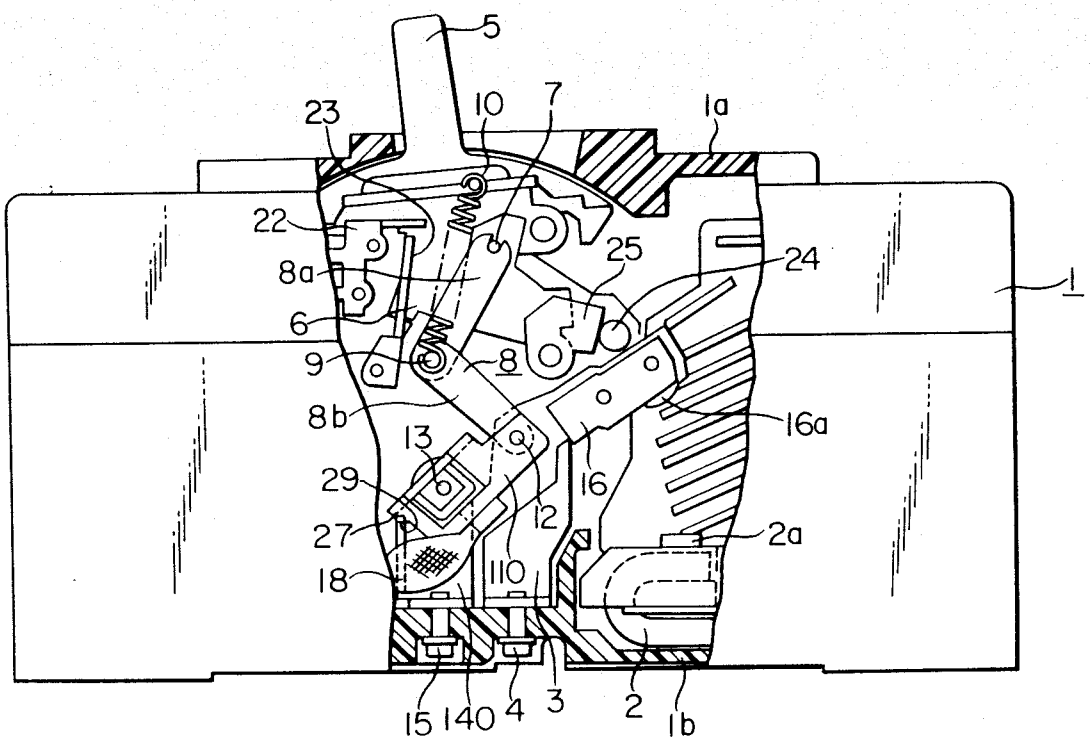
FIG. 4 is a view similar to FIG. 3 but illustrating the TRIP position.
Figure 5:
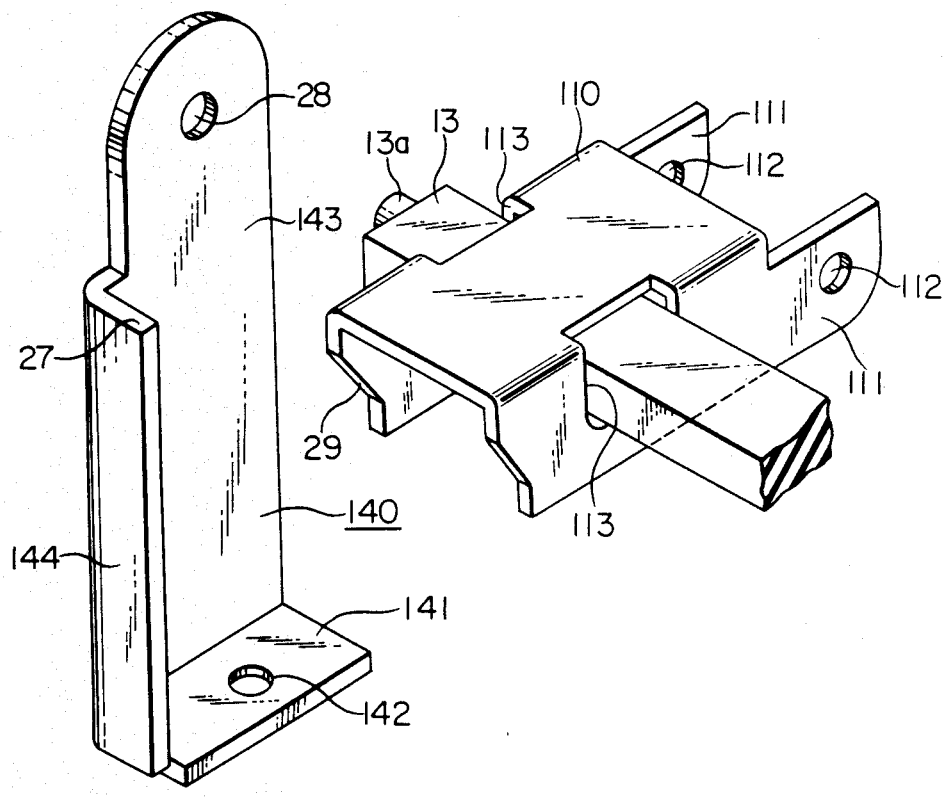
FIG. 5 is a perspective view illustrating the bearing assembly having an arrangement for determining the OFF position of the movable contact arm.

FIGS. 3 to 5 show the circuit interrupter of the present invention. FIG. 3 is a partly cut-away side view of the circuit interrupter of the present invention in the ON position, FIG. 4 is a view similar to FIG. 3 but illustrating the TRIP position, and FIG. 5 is a perspective view illustrating the bearing assembly having an arrangement for determining the OFF position of the movable contact arm.

The circuit interrupter of the present invention has a construction identical to the conventional design except for the construction of the bearing arrangement and the contact arm. As shown in FIGS. 3 to 5, the contact arm 110 of the movable contact assembly of the present invention has a stop surface 29 formed at the end secured to the cross bar 13, and the bearing assembly 140 has formed thereon a stop 27 adapted to be engageable with the stop surface 29 of the contact arm 110. While the bearing assembly 140 should be provided at each end of the cross bar 13 so as to rotatably support the cross bar 13 at both ends when the cross bar 13 has a length sufficient to be used in a multi-pole circuit interrupter, FIG. 5 illustrates only one of the bearing assemblies 140 since they have a construction similar to each other but in a mirror image. In a single pole circuit interrupter where the cross bar 13 or the shaft for rotatably supporting a single movable contact assembly is relatively short, two bearing assemblies may be connected by a single horizontal base portion to form an integral structure.

As best seen from FIG. 5 in which only one of the bearing assemblies 140 is illustrated, the bearing assembly 140 is a member made of a relatively thick metallic sheet material bent to have a horizontal mounting portion 141 having a through hole 142 through which the mounting screw 15 (FIG. 3) for securing the bearing assembly 140 to the base **1*b* of the housing extends. The bearing assembly 140 also has an upright portion 143 extending from the horizontal portion 141. The upright portion 143 has at its upper end portion a journal hole 28 within which a boss on the cross bar 13 is rotatably received. The upright portion 143 has formed at one of its side edges a bent portion 144 which provides a stop surface 27** on its upper edge.

The contact arm 110 is also a member made by bending a metallic sheet material and has extensions 111 with a hole 112 through which the pin 12 for connecting the contact arm 110 to the lower toggle link **8*b* extends. The contact arm 110 is mounted on the cross bar 13 for rotation therewith by means of rectangular holes 113 through which the cross bar 13 of rectangular cross-section extends. Since the cross bar 13 has a boss 13*a* at opposite ends which are rotatably journaled by the journal hole 28 of the bearing assembly 140, the contact arm 110 together with the cross bar 13 can be rotated about the bosses 13*a* relative to the bearing assemblies 140. The contact arm 110 of the present invention has a stop surface 29 at its end opposite to the extensions 111 with respect to the cross bar 13. The stop surface 29 of the contact arm 110 is arranged to be engageable with the stop 27 on the bearing assembly 140 when they are assembled and when the contact arm 110 is rotated to its OFF or TRIP position (FIG. 4), whereby an undesirable rotation of the movable contact arm 110** beyond a predetermined position is limited.

When the circuit interrupter is brought into an OFF position by the operating handle 5, the toggle link 8 collapses to move the movable contact assembly composed of the contact arm 110 and the movable contact carrier 16 in the opening direction. When the movable contact assembly reaches its final open position and immediately before the movable contact assembly hits the stopper pin 24, the stop surface 29 on the pivotted end of the contact arm 110 hits the stop surface 27 of the bearing assembly 140. Therefore, a further opening movement of the contact arm 110 and the movable contact carrier 16 is prevented.

According to the present invention, since the movement of the movable contact assembly carrying the movable contact element 16a is limited by the stop surface 27 provided on the bearing assembly 140 mounted on the base **1*b* of the housing, the frame for supporting the operating mechanism of the circuit interrupter is not vibrated by shock. Therefore, erroneous operations of the circuit interrupter due to vibration of the latch mechanism during the opening operation and the undesirable distortion of the movable contact carrier 16 due to repeated collisions against the stopper pin 24** are eliminated.

What is claimed is:

1. A circuit interrupter comprising in a housing:

a movable contact assembly having a movable contact carrier and a contact arm supporting said movable contacat carrier;

a cross bar secured to said movable contact assembly allowing said movable contact assembly to rotate therewith; and a bearing assembly secured to the housing and rotatably supporting said cross bar, said bearing assembly having a stop surface capable of being engaged by said movable contact assembly and determining the OFF position of said movable contact assembly.

* * * * *